United States Patent [19]

Mann

[11] Patent Number: 4,940,031

[45] Date of Patent: Jul. 10, 1990

[54] SETTING DEVICE FOR A FEED DEVICE OF AN INTERNAL COMBUSTION ENGINE

[75] Inventor: Arnold Mann, Biebergemünd, Fed. Rep. of Germany

[73] Assignee: VDO Adolf Schindling AG, Frankfurt am Main, Fed. Rep. of Germany

[21] Appl. No.: 381,123

[22] Filed: Jul. 14, 1989

[30] Foreign Application Priority Data

Aug. 12, 1988 [DE] Fed. Rep. of Germany ..... 3827408

[51] Int. Cl.[5] ..... F02D 41/16

[52] U.S. Cl. ..... 123/339; 123/337

[58] Field of Search ..... 123/339, 337, 630, 198 D; 290/40 C

[56] References Cited

U.S. PATENT DOCUMENTS 4,873,954 10/1989 Codling ..... 123/339

FOREIGN PATENT DOCUMENTS 3340060A 12/1984 Fed. Rep. of Germany ..... 123/339

*Primary Examiner*—Raymond A. Nelli

*Attorney, Agent, or Firm*—Martin A. Farber

[57] ABSTRACT

The present invention refers to a setting device for a feed device, particularly a throttle valve of an internal combustion engine with idling speed-of-rotation control in which the throttle valve, arranged in the intake pipe, is connected with a displacement rod and is pretensioned by a return spring. A first adjustable stop and a second fixed stop are provided for an actuating lever of the throttle valve, the second, fixed stop limiting the adjustment range of the first stop for a minimum opening of the throttle valve. An abutment member which is preferably developed as a lever cooperates with the two stops and is acted on by a mechanical reset means. By cooperation of the abutment member with the two stops, a control of the idling position of the throttle valve is one the one hand assured, a minimum opening position being fixed, and further an idling position of the throttle valve with a somewhat larger opening than the minimum opening is assured for the event that there should be a failure or a defect of the idling speed-of-rotation control.

13 Claims, 4 Drawing Sheets

SETTING DEVICE FOR A FEED DEVICE OF AN INTERNAL COMBUSTION ENGINE

FIELD AND BACKGROUND OF THE INVENTION

The present invention relates to a setting device for a throttle valve or for a feed device of an internal combustion engine with idling speed-of-rotation control, in which the feed device is connected to a displacement rod, and is pretensioned by a return spring. Furthermore, there are provided a first adjustable stop and a second fixed stop for an actuating lever of the feed device, the second fixed stop limiting the range of adjustment of the first stop for a minimum setting of the feed device.

As is known, the idling speed-of-rotation is controlled in order to improve the operating behavior of an internal combustion engine and to reduce the injurious components in the exhaust gases. For this purpose there is ordinarily provided an electric or pneumatic setting device which so sets a stop of a feed device, such as for instance a throttle valve or a control rod of an injection pump, that a desired idling speed-of-rotation is obtained. The operating conditions under which an internal combustion engine operates differ greatly and, accordingly, different desired values result for the idling speed-of-rotation, for instance upon cold start in winter, under high load due, for instance, to attached servo-devices and air-conditioning systems, when the internal combustion engine is warm or is operating with low load, etc. The range of adjustment of the stop must be correspondingly large in order to assure at all times the proper running of the internal combustion engine. Regulation of the idling speed-of-rotation to a minimum value has also become important for the reason that, in order to obtain favorable fuel consumption and emission values, the lowest possible idling speed-of-rotation is desirable and, in this way, there is present a possibility of variations in the idling speed-of-rotation, which makes a rapid resetting of the idling speed-of-rotation necessary.

At present, mechanical but with increasing frequency electronic, idling speed-of-rotation controls are being installed. These controls in the normal case assure, as desired, a sufficient but not excessively high idling speed-of-rotation corresponding to the existing operating conditions. For example, they control electric or pneumatic setting devices which shift the stop of the feed device to a suitable position. If a defect arises in these controls, assurance must be had that the idling speed-of-rotation is in such case set back to a small value. Otherwise, for example, in the case of automatic transmissions there may be an unintended forward movement, for example upon crawling of the vehicle, which may result in dangerous situations.

Upon the failure of an electronic control, however, an unfavorable idling speed-of-rotation can be brought about. If, namely, upon the failure, the stop is shifted in the direction of the minimum idling speed-of-rotation, then the minimum opening of the throttle valve may not be sufficient to assure satisfactory operation of the internal combustion engine and a throttling or standstill of the engine may take place.

German OS 35 24 911 describes a setting device of the aforementioned type for the throttle valve of an internal combustion engine in which the angular adjustment range is about 10°. No measure is disclosed for establishing an idling speed-of-rotation which assures reliable operation of the internal combustion engine upon the failure of the idling speed-of-rotation control.

German patent 29 49 884 describes a setting device for a feed device of an internal combustion engine with idling speed-of-rotation control which comprises a valve element which has a first set of openings for normal operating condition and a second set of openings of smaller cross-section for an abnormal operating condition. If a disturbance occurs, the openings of the first set are closed by simple means by spring action while the set of second openings provides an idling speed-of-rotation which assures operation of the engine.

SUMMARY OF THE INVENTION

It is an object of the invention to provide a setting device for a feed device of an internal combustion engine with idling speed-of-rotation with which, in the event of a defect in the idling speed-of-rotation control, an idling speed-of-rotation is established which is of such a value that a more dependable condition of operation of the internal combustion engine is assured.

According to the invention, in a setting device of the aforementioned type, an adjustable abutment element or member (40) which cooperates with a fixed stop (54; 86) and an adjustable stop (64; 94) are disposed on an actuating lever **(20; 18*a*; 18*b*) of a feed device (10), the abutment member (40) being acted on by a mechanical reset means (44). The abutment member (40), upon normal idling operation of the idling speed-of-rotation control is in engagement with the first adjustable stop (64; 94) and is located, against the action of the reset means (44), in a position out of engagement with the second fixed stop (54; 86). The abutment member (40), in the event of an abnormal idling speed operating condition of the idling speed-of-rotation control, in which it is out of engagement with the first adjustable and then reset stop (64; 94), is, under the action of the reset means (44), in engagement with the fixed stop (54; 86) and holds the actuating lever (20)** in such a manner that the feed device permits an adjustment somewhat greater than the minimum adjustment.

In the setting device of the invention the two stops, i.e. the fixed stop and the adjustable stop, are advantageously combined with a displaceable abutment member. Upon normal idling operation, the abutment member is in a position out of engagement with the fixed stop so that the establishing of the minimum idling speed-of-rotation is effected solely by the first adjustable stop. In the event of an abnormal condition of operation of the idling speed-of-rotation control, for instance when there is a failure of current or a defect in the electronic control, the first adjustable stop is set back completely and thus also the displaceable abutment member is set back as a result of the mechanical reset means which acts on it, so that it is in engagement with the fixed stop upon corresponding position of the actuating lever and, together with the latter, fixes the idling speed-of-rotation then present as minimum idling speed-of-rotation. The relative positions of abutment member and fixed stop are so selected in this connection that the corresponding idling speed-of-rotation is somewhat greater than the minimum idling speed-of-rotation possible in the normal operating condition. If the feed device is, for instance, a throttle valve, then the position of the throttle valve differs by a few degrees from the minimum opening position. The idling speed-of-rotation which is increased in this way makes it possible in each case safely to travel a relatively short distance, for instance in the workshop. On the other hand, the idling speed-of-rotation is not so high that, for instance, in the case of an automatic transmission, too great a forward travel is obtained, which, as mentioned, may lead to dangerous situations.

The setting device of the invention furthermore makes it possible in advantageous manner that no idle stroke upon actuation can be noted on the gas pedal when the gas pedal is actuated. This is assured in the manner that the displacement rod connected to the gas pedal is coupled with a return spring so that a stop position is provided which is determined by the corresponding stop of the feed device or throttle valve. This throttle-valve stop, upon both normal idling operating condition and also abnormal idling operating condition, represents the stop for the gas pedal, i.e. the basic position of the gas pedal is also established via the displacement rod. This is advantageous, in particular, in the case of internal combustion engines in which mechanical controllers are installed in the injection pump.

The abutment member is advisedly a lever (40) the position of which upon the abnormal idling operating condition is established by the mechanical reset means (44) and the second fixed stop (54; 86). This development permits a particularly simple displacement of the abutment member corresponding to the idling operating condition at the time. The lever (resistance member 40) is advantageously articulated to the actuating lever (20; 18*a*; 18*b*), as a result of which the space required is less and assembly is simplified. As a mechanical reset means, a torsion spring is preferably used. As alternative, a weight can be provided on the reset means.

The first adjustable stop is advisedly developed as an electric or electromagnetic setting member (60) or a pneumatic setting member which, for instance, comprises a displaceable rod which cooperates with the actuating lever of the feed device and is mechanically pretensioned by a return spring. Another preferred embodiment of the first adjustable stop is a roller (94) which facilitates the adjustment.

The second fixed stop is preferably an adjustment screw (54) for the adjustment of the minimum position of the feed device (10), for instance the minimum opening of the throttle valve. By means of this adjustment screw, the minimum opening for the normal operation of the idling speed-of-rotation control can be reset on the one hand. On the other hand, the idling speed-of-rotation provided for the abnormal idling operating condition can be displaced, coupled therewith. In this way a readjustment or adaptation to different types of engines and to age-induced changes can be effected. A pawl on the lever serving as abutment can also be provided as fixed stop, as a result of which the number of parts required is reduced. The second fixed stop can be a pawl (92) on the lever (40″). The actuating lever can comprise two rotatably mounted levers (18*a*, 18*b*). The feed device can be a throttle valve (10) arranged in an intake pipe (14) of the internal combustion engine. As another feature, the feed device can be a control rod of an injection pump.

BREIF DESCRIPTION OF THE DRAWINGS

With the above and other objects and advantages in view, the present invention will become more clearly understood in connection with the detailed description of preferred embodiments, when considered with the accompanying drawing, of which:

Figure 5:
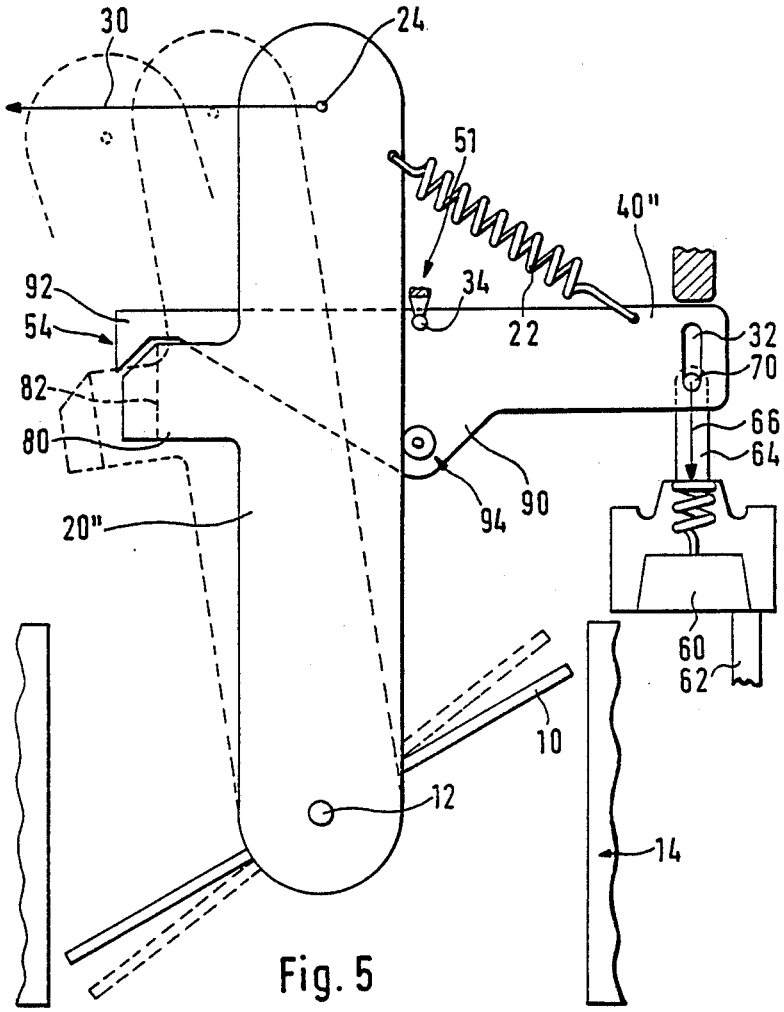
Figure 6:
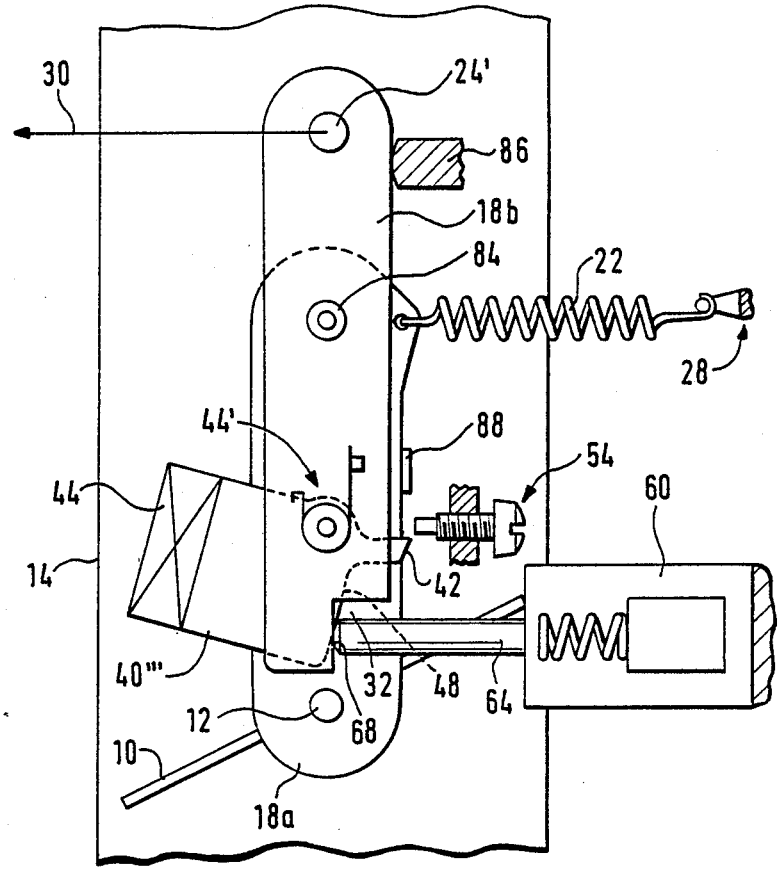

FIG. 5 is a diagrammatic partial view of a third embodiment of a setting device in accordance with the invention shown in a position according to a normal operating condition of the idling speed-of-rotation control, the position in an abnormal operating condition being shown by dashed line; and FIG. 6 is a diagrammatic partial sectional view of a fourth embodiment of a setting device according to the invention shown in a position in accordance with a normal operating condition of the idling speed-of-rotation control.

DETAILED DESCRIPTION OF THE PREFERRED EMBODIMENTS

First of all FIGS. 1 and 2 will be described, they showing a first embodiment of the setting device of the invention. A throttle valve 10, shown in dashed line, which is pivotable about a shaft 12 is arranged in an intake pipe 14 of an internal combustion engine (not shown).

Concentric to the shaft 12 and rigidly attached to it there is pivotably mounted an actuating lever 20. In the embodiment shown, the actuating lever 20 is developed with two approximately equally long arms 20*a*, 20*b* which form an angle of about 90° with each other, the shaft 12 or its extension passing through the line of symmetry between the two arms 20*a*, 20*b*. On the outer end of the arm 20*a* of the actuating lever 20 there are pivoted at 24 around a shaft a displacement rod (not further shown) as well as a return spring 22, which is indicated by a holding part 26 and an arrow 28. The direction of action of the displacement rod opposite that of the return spring 22 is indicated by an arrow 30.

On the other, free end of the actuating lever 20, i.e. on the free end of the arm 20*b*, the arm has a recess 32. Somewhat further away from the end, the arm 20*b* has a pivot shaft 34 on which a lever 40, serving as abutment, is articulated. The level 40 is developed substantially in the shape of a rod, the pivot shaft 34 being arranged eccentrically. The arrangement is such that when the lever 40 is horizontal it is substantially aligned with the arm 20*b* and its outer end extends beyond the arm 20*b*. The corresponding inner end of the lever 40 has in this position towards the bottom a projection 42 which extends at its lower end horizontally or parallel to the lower edge of the arm 20. At its outer end the lever 40 has a weight 44. The weight is of such a value that the lever 40 is swung by it into the position parallel to the arm 20*b* automatically against a rotation stop, not shown.

On the outside of the intake pipe 14 in FIGS. 1 and 2, somewhat below the arm 20*b*, there is welded a strap, plate or the like 50. An adjustment screw 52 is screwed with upward pointing threaded end 56 through a threaded bore hole 52 in the strap 50. The threaded end 56 extends in this connection so far upward that the projection 42 of the lever 40 rests, in the horizontal position of the lever, against the front end 58 of the adjustment screw.

Below the outer end of the arm 20*b* there is arranged an electromagnetic setting member 60 to which a supply line 62 extends. Towards the top, i.e. in the direction of the arm 20*b* of the actuating lever 20, there extends a displacement rod 64 which is displaceable in axial direction, as indicated by an arrow 66.

Figure 1:
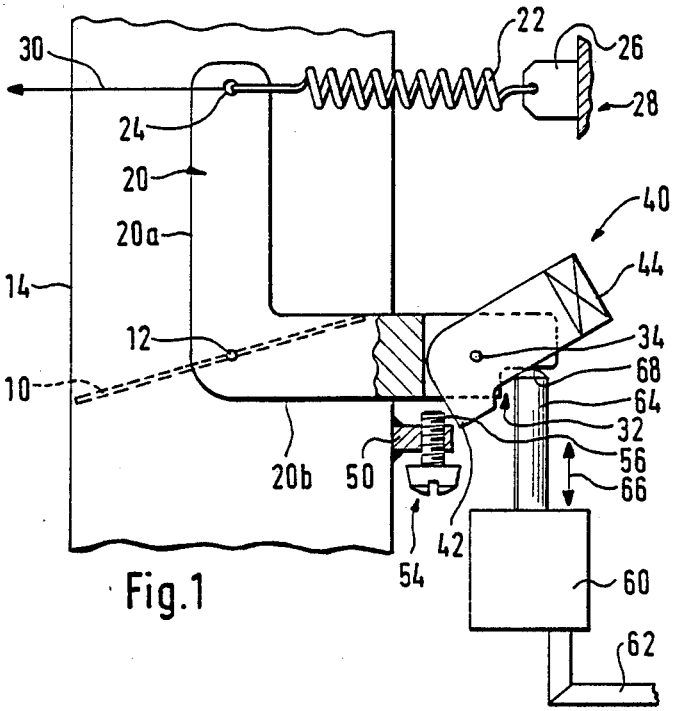
FIG. 1 is a diagrammatic partial sectional view of a first embodiment of a setting device according to the invention shown in a position in accordance with a normal operating condition of the idling speed-of-rotation control.

In FIG. 1 the displacement rod 64 is moved upward in such a manner that its front end 68 rests against the corresponding stop surface 36 of the arm 20*b* of the actuating lever 20. In this position, the displacement rod 64 is also in engagement with the lever 40 and has swung the latter in the position shown upwards out of the horizontal stop position. In this connection, the projection 42 of the lever 40 has been swung away by the adjustment screw 54 so that the latter cannot engage in this swung position with the adjustment screw. If the displacement rod 64 is moved further upward out of the position shown it would result in a swinging of the actuating lever 20 around the shaft 12, in which case the rigidly coupled throttle valve 10 would be swung in the opening direction. The further the displacement rod is shifted outward the more the open position of the throttle valve 10 for the idling position is increased.

The arrangement of the setting device shown in FIG. 1 corresponds to the position upon the normal operating condition of the idling speed-of-rotation control. If the latter becomes defective or if a disturbance of any kind occurs, the setting member 60 is so arranged that in such case the displacement rod 64 is instantaneously moved back. Together with this there takes place, on the one hand, a swinging back of the lever 40 under the action of its weight 44 and, on the other hand, a swinging back of the actuating lever 20 under the action of the return spring 22 into the horizontal position shown. The resultant arrangement is shown in FIG. 2 in which the projection 42 rests against the front end 58 of the adjustment screw 52. In this position the actuating lever 20 is swung a few degrees out of the position in which it is directly resting against the front end 58 of the adjustment screw 54, which represents the minimum opening of the throttle valve 10 upon ordinary control in the normal operating condition in accordance with FIG. 1. The small changes in angle of displacement upon the regulating of the idling speed-of-rotation are not shown in the diagrammatic showings of FIGS. 1 and 2. In the embodiment shown they amount to about 5°, which corresponds to an increase in the idling speed-of-rotation from about 800 rpm to about 1500 rpm.

Figure 2:
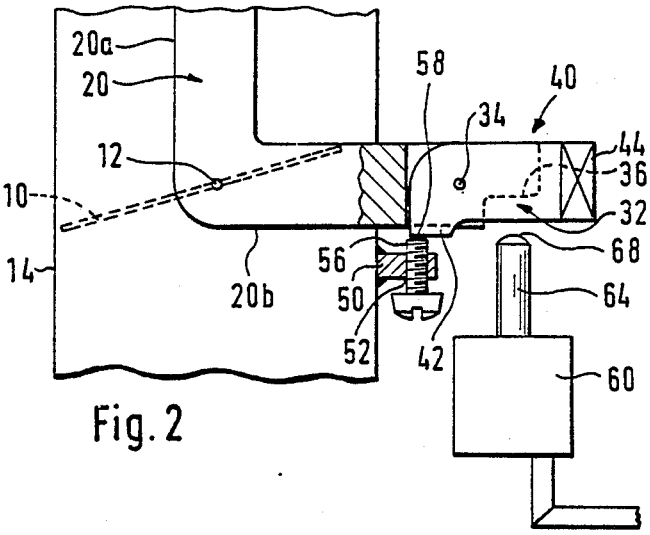
FIG. 2 is a view of the setting device shown in FIG. 1 in an abnormal condition of operation of the idling speed-of-rotation control.
Figure 3:
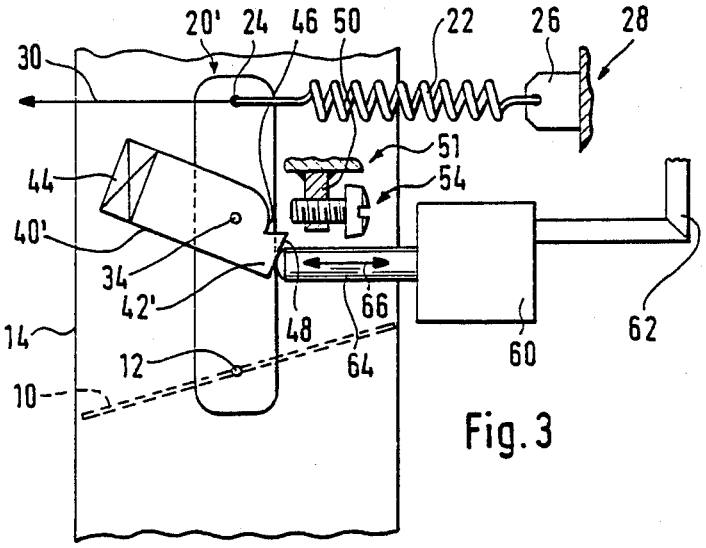
FIG. 3 is a diagrammatic partial sectional view of a second embodiment of a setting device according to the invention shown in a position in accordance with a normal operating condition of the idling speed-of-rotation control.
Figure 4:
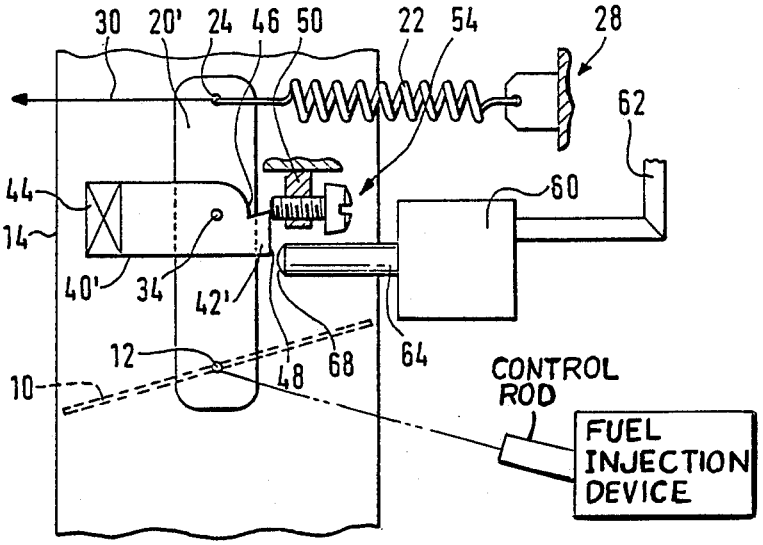
FIG. 4 is a view of the setting device shown in FIG. 3 in an abnormal operating condition of the idling speed-of-rotation control.

FIGS. 3 and 4 show another embodiment of a setting device in accordance with the invention. Insofar as the parts are the same as those of the embodiment shown in FIGS. 1 and 2, they have been provided with the same reference numbers and are not described again. The actuating lever 20' is developed with a single arm, each of the shafts 24 and 25 being arranged in the region of an end. The shaft 34, around which the lever 40 can be swung, is arranged somewhat above the center with respect to the lengthwise direction of the actuating lever 20.

The pivot shaft 34 of the lever 40' is arranged with respect to the latter at its front end, the weight 44 being accordingly on the rear end (to the left in FIGS. 3 and 4). The front end of the lever 40' is partially rounded off to form a notch 46, the lower region of the front side being developed at a right angle to the lengthwise direction of the lever 40' as lever front end 48. If no parts act on the lever 40' the latter is in horizontal position as a result of the action of the weight 44.

The adjustment screw 44 is screwed into the rigidly arranged strap 50, the rigid attachment of the strap 50 being indicated by the arrow 51. The adjustment screw 54 extends horizontally in such a manner that it is at right angles to the actuating lever 20 and can come into engagement with the facing longitudinal edge of the latter.

Below the adjustment screw 54 there is arranged a displacement rod 64 which is displaceable in horizontal direction in this embodiment and which, like the adjustment screw 54, enters into engagement with the facing longitudinal edge of the actuating lever 20 and swings the latter around the shaft 12 and, rigidly attached to it, the throttle valve 10. In the position shown in FIGS. 3, the displacement rod 64 is in engagement with the actuating lever 20 and with the front end 48 of the lever 40'. The lever 40' is in this way swung downward out of the horizontal position so that it comes out of engagement with the adjustment screw 54. In this way the adjustment screw 54 represents the limiting position for the minimum opening of the throttle valve 10 in the normal operating condition of the idling speed-of-rotation control.

Corresponding to FIG. 2, FIG. 4 shows the arrangement for the case of an abnormal condition of operation of the idling speed-of-rotation control. In this case, the displacement rod 64 of the setting member 60 is in the retracted position and the lever 40' is aligned horizontally in such a manner that its front end 48 is in engagement with the front end 58 of the adjustment screw in the idling condition, the throttle valve 10 being somewhat further open in this position than in the case of the minimum opening position in accordance with FIG. 3. In this way, a throttling of the engine in such exceptional cases is prevented, so that dependable travel is still assured without it being possible for the engine to assume too high a speed.

If desired, the feed device, described as the throttle valve 10, may also be the control of a fuel injection device as indicated diagrammatically in FIG. 4.

FIG. 5 shows a third embodiment of a setting device in accordance with the invention. Insofar as the parts are identical to those of the two embodiments described, they have been provided with the same reference numbers and will not be described again. The actuating lever 20'' is developed with a single arm, the shaft 12 being arranged in the region of one end. Somewhat eccentrically, further away from the shaft 12, the actuating lever 20'' has a nose 80 which extends approximately at a right angle in the direction of the arrow 30 and has a recess, which is indicated by a dashed line 82.

The lever 40'' is swingably pivoted to the swing shaft 34 which is arranged in fixed position (see arrow 51). The swing shaft 34 is located substantially in the center of the lengthwise direction of the lever 40''. Somewhat towards the outside, shifted in the opposite direction to the arrow 30, there is fastened one end of the return spring 22 the other end of which is arranged in the upper end region of the actuating lever 20''. On the right-hand side in FIG. 5 the lever 40″ has, as recess 32, a slot within which a driver 70 of the displacement rod 64 of the pneumatic or electric setting member 60 is displaceably guided. Approximately at the height of the swing shaft 34, the lever 40″ has on its lower longitudinal edge an outward arching 90 which tapers down towards the end opposite the recess 32 with the formation of a pawl 92. A roller 94 is located in the region of the arching.

In the showing of FIG. 5, the actuating lever 20″ is shown in solid line in the position in accordance with a condition of normal operation of the idling speed-of-rotation control. In this position, the roller 94 is in engagement with the longitudinal edge of the actuating lever 20″ and represents the adjustable stop. The pawl 92 of the lever 40″ is out of engagement with the fixed stop of the nose 80 formed by the recess 82. The position for an abnormal condition of idling operation of the idling speed-of-rotation control is shown in dashed line. In this connection the actuating lever 20″ is swung somewhat toward the left in FIG. 5 around the shaft 12 together with the throttle valve 10 and the pawl 92 is in engagement with the recess 82. This position can also be reached from the position shown in solid line for the minimum idling speed-of-rotation by the single giving of gas. The position of the actuating lever 20″ for the maximum idling speed-of-rotation is shown merely in dashed line, the actuating lever being swung still further towards the left in this position.

FIG. 6 shows a fourth embodiment of a setting device according to the invention in a position in accordance with a normal condition of operation of the idling speed-of-rotation control. Insofar as the parts are identical to those of the three embodiments described they are provided with the same reference numbers and are not described again. The actuating lever is developed in two parts and consists of a body lever 18*a* and an articulation lever 18*b* which are swingably mounted with respect to each other via a shaft 84. The articulation lever 18*b* has its upper end connected to the displacement rod, a fixed stop 86 being provided on the side opposite thereto, with which stop the articulation lever 18*b* can be brought into engagement at about the height of the point of attack 24′ of the displacement rod. On the opposite end, the articulation lever 18*b* has the recess 32 with which the displacement rod 64 of the pneumatic or electric setting member 60 can be brought into engagement. The body lever 18*a* is connected, in the region of the upper end, approximately at the height of the shaft 84, to one end of the return spring 22 the other end of which is fixed in position, as indicated by the arrow 28. On the opposite end, the body lever 18*a* has the shaft 12 around which the throttle valve 10 is swingable. Approximately at mid-height there is another stop 88 with which the articulation lever 18*b* can be brought into engagement.

The lever 40‴ is swingably mounted on the articulation lever 18*b*. The front end has a projection 42 which can be brought into engagement with an adjustment screw 54. At the other end there is a weight 44. As an alternative to the weight 44 a torsion spring 44′ can be provided. The displacement rod 64 can be brought into engagement with the front end of the lever 40‴ and deflects the latter from the position of rest. The lever 40‴ is moved back into the horizontal position of rest by the weight 44 or the torsion spring 44′ when the displacement rod 64 is not in engagement with the front end 48.

The fourth embodiment described in suitable in particular for uses in which the setting member has a large stroke and makes the required transmission ratio available. In normal operation, the articulation lever 18*b* rests against the stop 88 at speeds of rotation which are greater than the minimum idling speed-of-rotation. In this position, the lever 40‴ is swung out of the position of rest by the action of the displacement rod 64. If the idling speed-of-rotation control fails, the projection 42 of the lever 40‴ comes into engagement with the setting screw 54. The internal combustion engine then travels with the emergency speed of rotation determined by the adjustment screw 54.

I claim:

1. In a setting device for a feed device of an internal combustion engine with idling speed-of-rotation control, the setting device comprising a displacement rod, a return spring, a first adjustable stop, a second fixed stop, and an actuating lever of the feed device; and wherein the feed device is connected to the displacement rod and is pretensioned by the return spring;

the first adjustable stop and the second fixed stop are operative with the actuating lever of the feed device, the second fixed stop limiting the range of adjustment of the first stop for a minimum setting of the feed device; and wherein the feed device further comprises a mechanical reset means, and an adjustable abutment element which cooperates with the fixed stop and the adjustable stop;

the abutment element is located on the actuating lever of the feed device, and is acted on by the mechanical reset means;

the abutment element, upon normal idling operation of the idling speed-of-rotation control is in engagement with the first adjustable stop and is disposed, against an action of the reset means, in a position out of engagement with the second fixed stop; and the abutment element, in the event of an abnormal idling speed operating condition of the idling speed-of-rotation control in which the abutment element is out of engagement with the first adjustable stop and then reset, is in engagement, under the action of the reset means, with the fixed stop and holds the actuating lever for the feed device to permit an adjustment of the feed device somewhat greater than the minimum adjustment.

2. A setting device according to claim 1, wherein said abutment element is formed as a lever the position of which upon the abnormal idling operating condition is established by the mechanical reset means and the second fixed stop.

3. A setting device according to claim 2, wherein the abutment element lever is articulated to the actuating lever.

4. A setting device according to claim 3, wherein said mechanical reset means comprises a torsion spring.

5. A setting device according to claim 3, wherein said reset means comprises a weight.

6. A setting device according to claim 1, wherein said first adjustable stop comprises an electric setting element.

7. A setting device according to claim 1, wherein said first adjustable stop comprises an electromagnetic setting element.

8. A setting element according to claim 1, wherein said first adjustable stop is a roller.

9. A setting device according to claim 1, wherein said second fixed stop comprises an adjustment screw for adjustment of a minimum position of the feed device.

10. A setting device according to claim 2, wherein said second fixed stop is a pawl on said abutment element lever.

11. A setting device according to claim 1, wherein said actuating lever comprises two rotatably mounted levers pivotally connected to each other.

12. A setting device according to claim 1, wherein the device is a throttle valve arranged in an intake pipe of the internal combustion engine.

13. A setting device according to claim 1, wherein the feed device is a control rod of an injection pump.

* * * * *